United States Patent [19]

Fukushima

[11] Patent Number: 5,044,279

[45] Date of Patent: Sep. 3, 1991

[54] CONNECTOR FOR A BOMB AND A METHOD FOR SUCKING LIQUID IN A BOMB

[75] Inventor: Mikitake Fukushima, Osaka, Japan

[73] Assignee: Daikin Industries, Ltd., Osaka, Japan

[21] Appl. No.: 552,093

[22] Filed: Jul. 13, 1990

[30] Foreign Application Priority Data

Jul. 21, 1989 [JP] Japan ..... 1-189340

[51] Int. Cl.[5] ..... F42B 33/06; F25B 45/00

[52] U.S. Cl. ..... 102/293; 62/292

[58] Field of Search ..... 102/293, 382, 704; 62/50, 51, 54, 55, 292, 299, 389, 529; 222/3

[56] References Cited

U.S. PATENT DOCUMENTS

| | | | |
|---|---|---|---|
| 2,520,215 | 8/1950 | Kerr . | |
| 3,759,291 | 9/1973 | Moore et al. | 62/292 |
| 4,046,055 | 9/1977 | McDanolds et al. | 102/293 |
| 4,476,892 | 10/1984 | Boyce | 62/292 |

FOREIGN PATENT DOCUMENTS 3625714 2/1988 Fed. Rep. of Germany .

*Primary Examiner*—Charles T. Jordan

[57] ABSTRACT

A connector for a bomb includes a case capable of covering a projected opening of the bomb; a case fastening device for fastening the case onto the bomb by utilizing an outer circumferential recess of the projected opening; a handle having a shaft portion and a handle portion with the shaft portion being arranged to rotatably and movably pass through a top wall of the case and the handle portion being positioned outside the case; a threaded plug retainer which is fixed to an end of the shaft portion and is detachably engaged with a threaded plug screwed onto the projected opening; a first sealing member for sealing between an end portion of a side peripheral wall of the case and the bomb; and a second sealing member for sealing between the shaft portion and the case. The case is fastened to the bomb by the case fastening device so as to cover the projected opening of the bomb and to form a hermetic chamber, and by operating the handle, the threaded plug retainer engaged with the threaded plug is turned so as to detach the threaded plug from the projected opening, and liquid in the bomb is sucked out through the hermetic chamber.

22 Claims, 7 Drawing Sheets

CONNECTOR FOR A BOMB AND A METHOD FOR SUCKING LIQUID IN A BOMB

BACKGROUND OF THE INVENTION

The present invention relates to a connector installed onto an opening of a bomb charged with a liquid, and particularly of a bomb charged with a refrigerant, and capable of taking out the charged Freon without causing the leakage of liquid or gas into the environment.

Although various kinds of Freons are widely used for such as refrigerant for refrigerators, rinsing liquid for electronic elements, and pressuring gas for aerosol products because of the odorlessness, inertness and other advantages thereof, as is well known, the Freon gas leaked and diffused in the atmosphere has recently become an international problem for the reason that it destroys the ozone layer, resulting in the global contamination.

Meanwhile, taking a centrifugal refrigerator as a example, an operation of charging a kind of refrigerant, R-11 (boiling point, 23.8° C.) into the refrigerator will be described as follows: Conventionally, as shown in an explanatory sketch of FIG. 14, after an opening 28 provided on a top plate 27*a* of a drum-shaped bomb 27 is opened by removing a threaded plug 29 shown in FIG. 13*a* screwed thereon, an end portion of a hose 30 is inserted into the bomb 27 through the opening 28, and by utilizing the pressure difference between the bomb 27 and the refrigerant reservoir of the refrigerator, R-11 is extracted from the bomb 27 and supplied to the refrigerator.

In the above refrigerant charging operation, the machine room where the bomb 27 is located is considerably hot even in the middle season such as the spring and fall, and accordingly, it is inevitable that a high density of R-11 vapor leaks from the opening 28 of the bomb 27, and the diffusion thereof into the atmosphere has been a problem to be solved.

Therefore, it has been suggested as a standard operation manual that with the bomb 27 being held below the temperature (boiling point 23.8° C.) by cooling with ice water or chilled water, the extraction of R-11 is made under a cool state by removing the threaded plug 29.

However, this operation procedure has a problem in that it takes a considerable time and cost increase to cool, and furthermore, since the temperature will increase as time passes during charging, the temperature of R-11 will rise and the evaporation thereof will take place, resulting in the danger of gas leakage, unless the cooling is continued.

Furthermore, since the bomb 27 is open to the atmosphere, at the final time point of the liquid extraction, air flows into the hose and there is a danger of air suction into the refrigerant system of the refrigerator. Therefore, an operator has to watch up to the final stage of the charging, resulting in a problem that he is not able to do an other operations.

SUMMARY OF THE INVENTION

Accordingly, the essential object of the present invention is to provide a connector which is simple and easy to handle and capable of eliminating any leakage of refrigerant to the ambient.

In order to accomplish the object of the present invention, a connector for a bomb according to the present invention comprises a case which has a top wall and a side peripheral wall with an opening for liquid discharging being formed on at least one of the top and side peripheral walls, and is capable of covering a projected opening of the bomb;

a case fastening device for fastening the case onto the bomb by utilizing an outer circumferential recess of the projected opening of the bomb;

a handle comprised of a shaft portion and a handle portion fastened to one end of the shaft portion with the shaft portion being arranged to rotatably and movably pass through the top wall of the case and the handle portion being positioned outside the case;

a threaded plug retainer which is fixed to the other end of the shaft portion of the handle and is detachably engaged with a threaded plug screwed onto the projected opening of the bomb;

a first sealing member for sealing between an end portion of the side peripheral wall of the case and the bomb; and a second sealing member for sealing around the shaft portion of the handle, whereby the case is fastened to the bomb by the case fastening device so as to cover the projected opening of the bomb and to form a hermetic chamber, and by operating the handle, the threaded plug retainer engaged with the threaded plug is turned so as to detach the threaded plug from the projected opening of the bomb, and liquid in the bomb is sucked out through the hermetic chamber and the opening on the case.

It is preferable that the case fastening device comprises:

a base composed of a flat plate portion disposed within the case, passed through by the shaft portion of the handle and capable of being tightly fit to an inside of the top wall of the case, and a cylinder portion integrated to the flat plate portion, rotatably and movably passed through by the shaft portion of the handle, and threaded on an outer surface of the cylinder portion;

a plurality of anchor members, each composed of an arm portion swingably hung onto the flat plate portion of the base and a hook connected to an end of the arm portion and capable of engaging with the outer circumferential recess of the projected opening of the bomb; and a nut engaging with threads formed on the outer surface of the cylinder portion of the base so as to pull up the base connected to the outer circumferential recess of the projected opening of the bomb by means of the anchor members and tightly push the flat plate portion of the base against the inside of the top wall of the case and at the same time, to push down the top wall of the case and push the end portion of the side peripheral wall of the case against the top wall of the bomb with the first sealing member being interposed between the end portion of the side peripheral wall of the case and the top wall of the bomb; and there is further provided a third sealing member for sealing between the inside of the top wall of the case and the flat plate portion of the base.

Alternatively, it is preferable that the end portion of the side peripheral wall of the case can be contacted with an upper end surface of the projected opening of the bomb;

the case fastening device comprises:

a pair of saddle-shaped members enclosing the case and detachable from each other, each of the saddle-shaped members having a semi-circular cylinder portion, connection flanges integrally provided on both side ends of the semi-circular cylinder portion, a semi-circular wall integrally provided on an upper edge of the semi-circular cylinder portion and an inner flange projecting inward from a lower end of the semi-circular cylinder portion so as to become engaged with the outer circumferential recess of the projected opening of the bomb, and a pushing member for pushing down the top wall of the case, which has threads formed on an outer surface of the pushing member, engaging with a threaded hole formed on a center of a top wall composed of the semi-circular walls of the saddle-shaped members, with the shaft portion of the handle passing through a center portion of the pushing member; and the second sealing members seal between the case and the shaft portion of the handle, whereby a pair of the saddle-shaped members are connected with each other by means of the connection flanges so as to enclose the case in the saddle-shaped members and engage the inner flange with the outer circumferential recess of the projected opening of the bomb, and the pushing member is screwed in the threaded hole on the top wall composed of the semi-circular wall of the saddle-shaped members so as to pull up the saddle-shaped members and hook the inner flange to the outer circumferential recess of the projected opening of the bomb, and at the same time to push the end portion of the side peripheral wall of the case against the upper end of the projected opening of the bomb with the first sealing member being interposed between the end portion of the side peripheral wall of the case and the upper end of the projected opening of the bomb.

Alternatively, it is preferable that the end portion of the side peripheral wall of the case is able to press the first sealing member against the top wall of the bomb, and the case has an inner flange extending inward from the end portion of the side peripheral wall of the case close to the outer circumferential recess of the projected opening of the bomb, and the case fastening device comprises:

a plurality of arc-shaped wedge members of approximately triangular section which are arranged to be slid along the inner flange and become hooked to the outer circumferential recess of the projected opening of the bomb, a ring-shaped band enclosing outer peripheries of the wedge members, and an operation shaft which is connected to both ends of the band, piercing the case and is capable of operating from the outside of the case so as to tighten or loosen the band, whereby the band is tightened by the operation shaft so as to hook the wedge members into the outer circumferential recess of the projected opening of the bomb and the inner flange of the case is pushed against the top wall of the bomb through the arc-shaped wedge members so as to fasten the case onto the bomb; and a fourth sealing member is provided between the operation shaft and the side peripheral wall of the case.

It is preferable to comprise springs forcing the hooks of the anchor members to be pushed against the side peripheral wall of the case, whereby by moving the case toward the bomb relative to the anchor members, the anchor members contacting an inner edge of the end portion of the side peripheral wall of the case can be swung inward so as to engage the hooks of the anchor members with the outer circumferential recess of the projected opening of the bomb.

It is preferable that there is provided a magnet on the threaded plug retainer so as to confront and attract the threaded plug.

It is preferable that on an end face of the threaded plug retainer, there are provided two convex parts of approximately semi-circular shape separated from each other by a central groove, and both end portions of the central groove are expanded in V-character shape toward ends of the central groove respectively, whereby the threaded plug retainer is able to fit in both a threaded plug having two semi-circular concave parts and a threaded plug having two V-character shape convex parts.

The method for sucking out liquid in a bomb according to the present invention comprises the steps of:

arranging a cup-shaped case having a side peripheral wall and a top wall so as to cover a projected opening of a bomb;

fastening the case onto the bomb by pushing the case against the bomb by means of a case fastening device hooked onto an outer circumferential recess formed on the projected opening of the bomb so as to form a hermetic chamber within the case with a seal member;

engaging a threaded plug retainer fastened on an end of a shaft portion of a handle passing through the top wall of the case with a threaded plug on the bomb and removing the threaded plug from the bomb by turning the handle; and sucking out liquid in the bomb through the hermetic chamber and an outlet for piping provided on the case.

Also, the method for charging liquid in a bomb according to the present invention comprises steps of:

arranging a cup-shaped case having a side peripheral wall and a top wall so as to cover a projected opening of a bomb;

fastening the case onto the bomb by pushing the case against the bomb by means of a case fastening device hooked onto an outer circumferential recess formed on the projected opening of the bomb so as to form a hermetic chamber within the case with a seal member;

engaging a threaded plug retainer fastened on an end of a shaft portion of a handle passing through the top wall of the case with a threaded plug on the bomb and removing the threaded plug from the bomb by turning the handle; and changing liquid in the bomb through the hermetic chamber and an inlet for piping provided on the case.

Since the hermetic chamber in the case is maintained air-tight by the sealing means, and the liquid charging into a refrigerator is effected under the air tight conditions, there is no gas leakage of charged liquid such as R-11 and R-113 to the outside ambient.

It is to be noted that when air in the case is replaced with an inert gas such as $N_2$ by utilizing the opening of the case before the liquid suction operation and then the liquid suction operation is effected, it is possible to effect liquid suction while eliminating air suction into the refrigerator.

Furthermore, this connector is applicable not only to the liquid extraction from a bomb, but also to the liquid charging into a bomb. That is, the liquid transfer under the air tight condition is possible The effects of the connector constituted as described above according to the present invention are as follows:

(A) By using the connector of the present invention, it is possible to form a high air tightness level of a hermetic chamber around a projected opening of a bomb with the opening being closed as well as to open or close the opening within the hermetic chamber by turning of the handle. Therefore, the liquid in the bomb can be sucked without causing gas leakage into the outside ambient, and thus the problem of the atmosphere contamination is solved.

(B) According to the present invention, it is possible to effect the liquid suction operation at a normal temperature without the necessity of cooling the bomb, and the time and cost incurred by the liquid suction operation can be greatly reduced.

(C) Furthermore, since the suction operation is possible at a normal temperature, in the case of R-12 and R-113, the liquid suction under a pressurized state can be effected easily and rapidly.

(D) Since the inside of the bomb is completely shut out from the atmosphere in the liquid suction operation, it is possible to absolutely eliminate an air suction phenomenon on a machine, for example, refrigerator, the operation cost can be reduced by saving a personnel required for watching.

(E) In the case of providing springs urging the hooks of the anchor members toward the side peripheral wall of the case, it becomes easy to fasten the connector onto the bomb.

(F) In the case that the lower end of the case fastening device is engaged with the outer circumferential recess of the projected opening of the bomb and the case within the case fastening device is pushed down the upper end of the projected opening so as to form a hermetic chamber, even when the projected opening is formed on the side peripheral wall constituting the cylindrical surface of the bomb, it is possible to form a hermetic chamber and suck out liquid.

(G) In the case that a magnet is provided on a threaded plug retainer, it is possible to effect the operation securely without causing the dropping of the threaded plug.

(H) In the case of arranging the geometry of the end face of the thread plug retainer so as to be applicable commonly to existing two kinds of thread plug, the two kinds of thread plug can be handled with a single kind of the connector.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
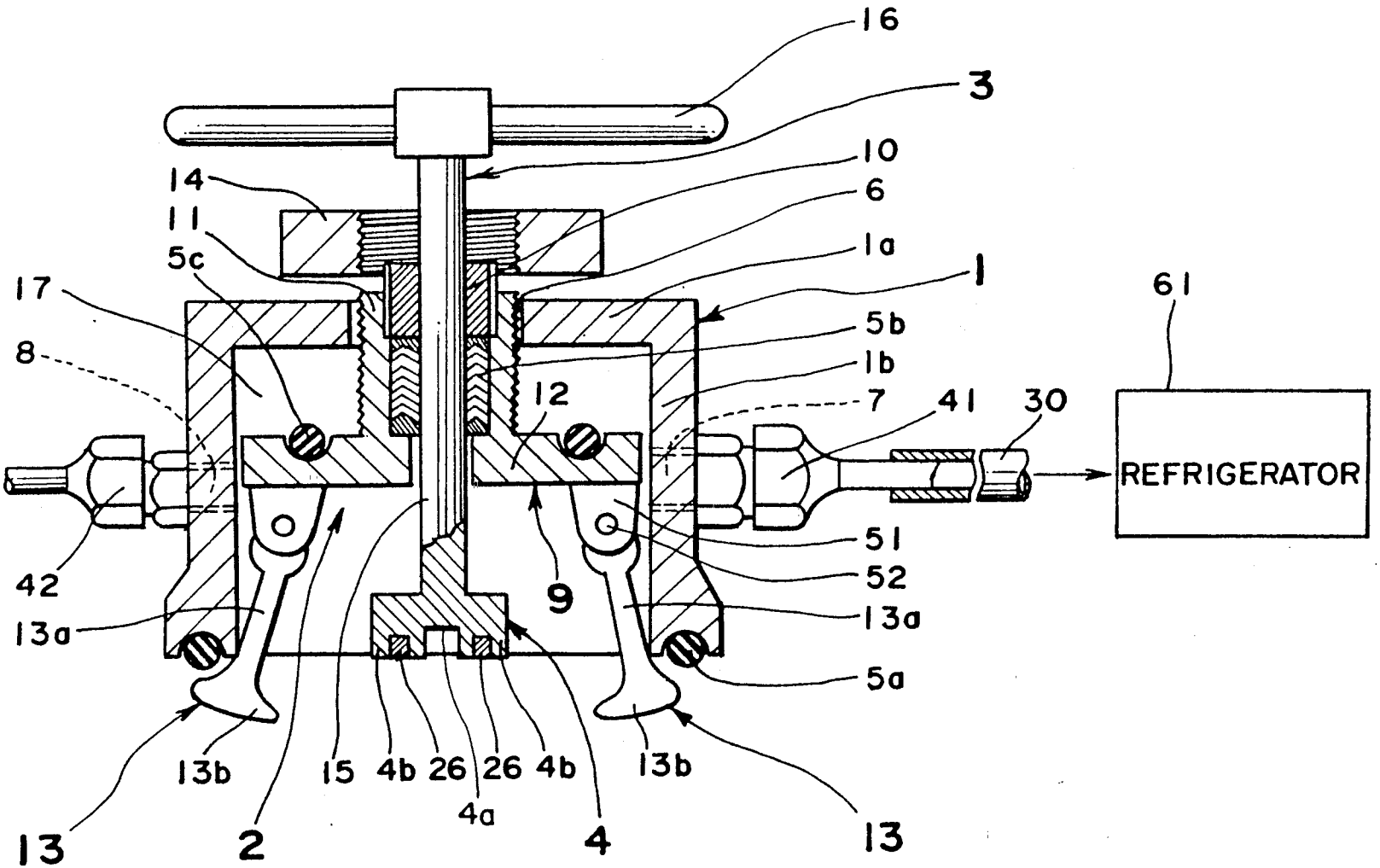
FIG. 1 is a longitudinal sectional view of a connector for a bomb of a first preferred embodiment according to the present invention.

Before the description of the present invention proceeds, it is to be noted that like parts are designated by like reference numerals throughout the accompanying drawings.

The connector according to the present invention shown in FIG. 1 comprises a case 1, a case fastening device 2, a handle 3, a threaded plug retainer 4, and a plurality of sealing members 5*a*, 5*b* and 5*c*.

The case 1 comprises a top wall 1*a* and a side peripheral wall 1*b*, and is formed in a top-covered cylinder with the bottom thereof opened, and a circular hole 6 is bored on the central portion of the top wall 1*a*, and at the positions approximately in the middle level of the vertical height of the side peripheral wall 1*b*, there are provided a liquid suction port 7 of a large diameter and a smaller service port 8 with connection joints 41, 42 for piping connection respectively installed thereon.

Figure 2A:
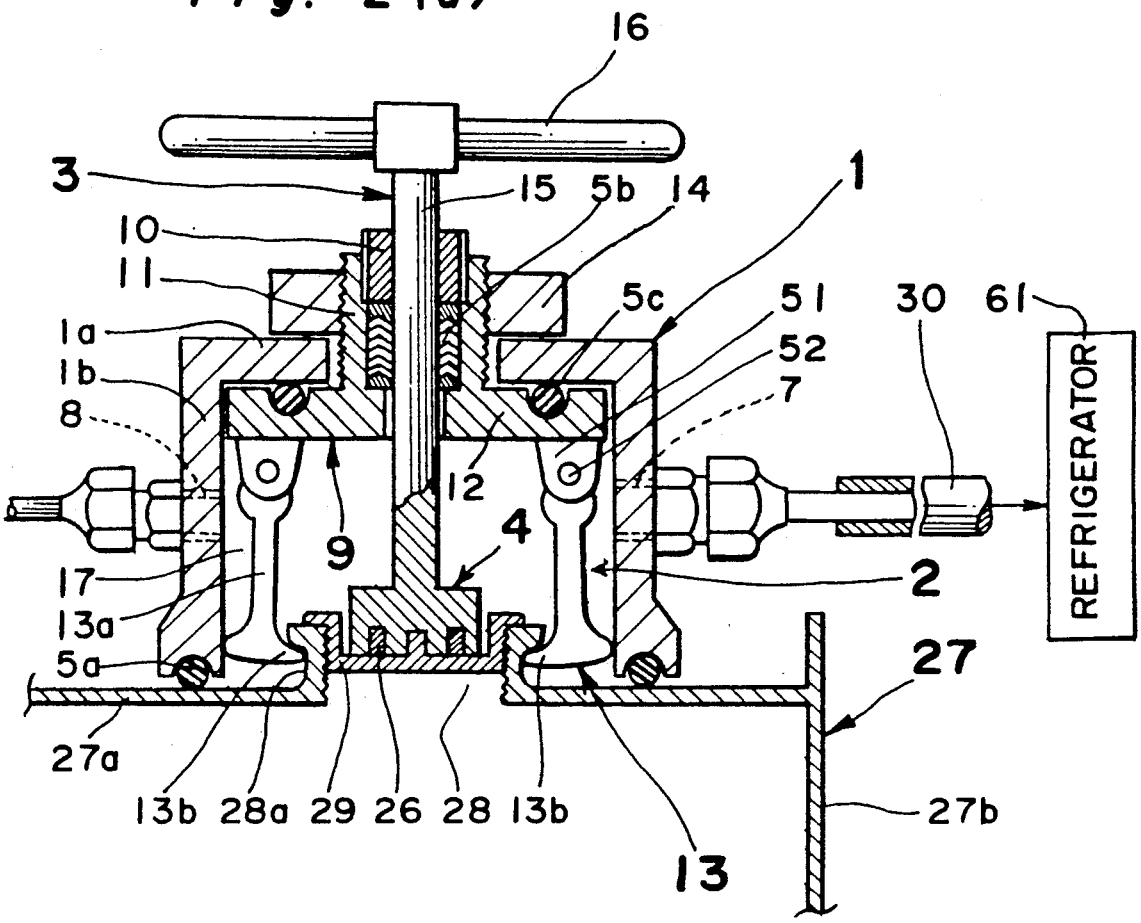
FIGS. 2(*a*) and 2(*b*) are explanatory drawings for explaining how to use the connector for a bomb of the first preferred embodiment according to the present invention.

As shown in FIG. 2*a*, the lower end of the side peripheral wall 1*b* of the case 1 is arranged to come into contact with the top plate portion 27*a* around the projected opening 28 of a bomb 27, and forms an outer casing of the connector.

On the tip end portion of the side peripheral wall 1*b* of the case 1, there is provided a ring-shaped sealing member, for example, a rubber O-ring 5*a* in order to maintain air tightness when contacting the top plate 27*a* of the bomb 27.

The case fastening device 2 comprises a base 9, a plurality of, for example, four anchor members 13 and a nut 14, and the base 9 is formed in a flange shape with a cylinder portion 11 threaded on the outer surface thereof and a flat plate portion 12 coaxially integrated thereto, and the cylinder portion 11 is put through the circular hole 6 and the flat plate portion 12 is laid horizontally within the case 1.

On the other hand, each anchor member 13 comprises an arm portion 13*a* and a hook 13*b*, and on respective brackets 51 provided at the positions obtained by dividing the lower circumference of the flat plate portion 12, the respective upper ends of the arm portions 13*a* are pivotally hung by pins 52 to the flat plate portion 12 so that hooks 13*b* integrally formed on the lower ends of the arm portions 13*a* become swingable round an axial line passing through the center of the flat plate portion 12 so as to approach the axial line or depart further therefrom.

Figure 2B:
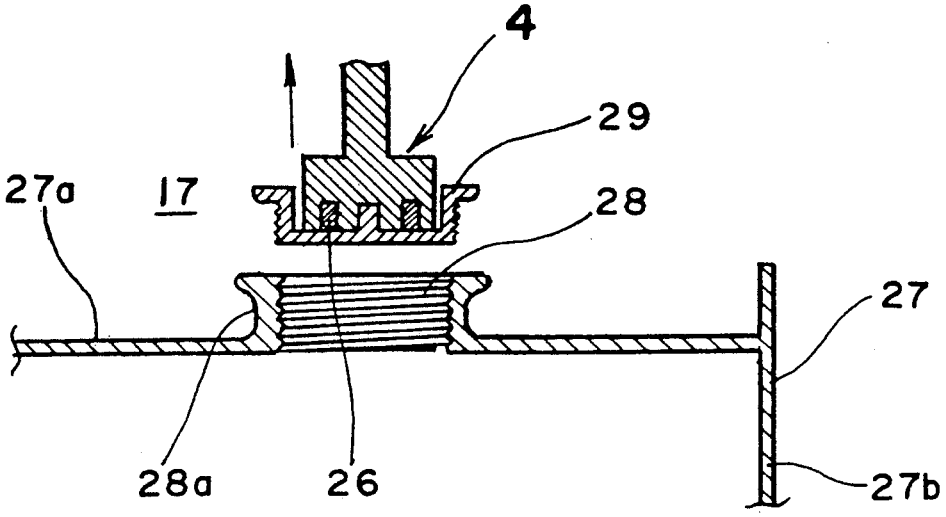

As shown in FIG. 2(*a*), when the case 1 is placed to cover the outside of the anchor members 13, the anchor members 13 become approximately vertical with the anchor peripheral wall 1*b* of the case 1, and the tip ends of the hooks 13*b* become hooked with the outer circumferential recess 28*a* of the projected opening 28 of the bomb 27. On the other hand, when the case 1 is pushed upward relative to the anchor members 13 as shown in FIG. 1, the tip ends of the hooks 13*b* can be removed from the outer circumferential recess 28*a* of the projected opening 28 by contacting the central portions of arms 13*a* of the anchor members 13 with the lower end of the side peripheral wall 1*b* of the case 1 and extending the anchor members 13 downward in a cone shape.

As shown in FIG. 1, by moving the case fastening device 2 of such a structure downward relative to the case 1, the anchor members 13 are expanded, and then, as shown in FIG. 2(*a*), it is put in the case 1 so that the cylinder portion 11 of the base 9 pierces through the circular hole 6 of the case with a nut 14 being screwed onto the threaded portion of the outward protruding cylinder portion 11. By fully screwing the nut 14, the case 1 and the case fastening device 2 become integrated with each other, and the hooks 13*b* are hooked onto the outer circumferential recess 28*a* of the opening 28, pushed by the side peripheral wall 1*b* of the case 1 and thus fastened to the opening 28.

Thus, in the state where the case fastening device 2 has hooked the anchor members 13 onto the outer circumferential recess 28*a* of the opening 28, the case fastening device 2 is lifted by screwing up of the nut 14 to the cylinder portion 11 and to the contrary, the case 1 is pushed downward against the top plate 27*a* of the bomb 27, and thus the connector is fixed to the bomb 27 with the opening 28 of the bomb 27 being covered by the case 1.

In this fixing state, in order to maintain an air tightness between the flat plate 12 of the case fastening device 2 and the top wall la of the case 1, there is provided a ring-shaped sealing member 5*c*, for instance, an O-ring on the upper surface of the flat plate 12.

On the other hand, the handle 3 is comprised of a shaft portion 15 made of a proper length of circular steel rod, and a handle portion 16 provided on the upper end portion of the shaft portion 15. A threaded plug retainer 4 is provided on the lower end portion of the shaft portion 15. The shaft portion 15 is arranged to loosely pass through the hole provided at the center of the cylinder portion 11 and the flat plate portion 12 of the base 9 so as to be rotatable and movable in the axial direction.

And, between the cylinder portion 11 of the base 9 and the shaft portion 15 of the handle 3, ring-shaped sealing members 5b, that is, grand packings of V-shaped section are inserted in order to maintain the air tightness at this portion and also to support the shaft portion 15. The sealing members 5*b* is pressed by a gland 10.

Figure 12:
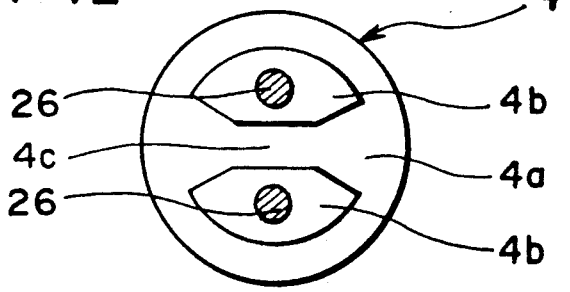
FIG. 12 is a lower end view of a threaded plug retainer in a connector for a bomb according to the present invention.
Figure 13A:
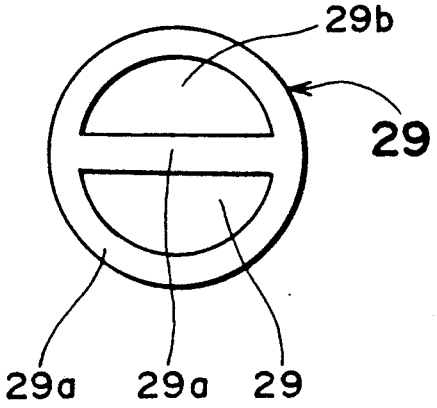
Fig. 13(a) PRIOR ART
FIGS. 13(*a*) and 13(*b*) are upper end views of threaded plugs for bombs.
Figure 13B:
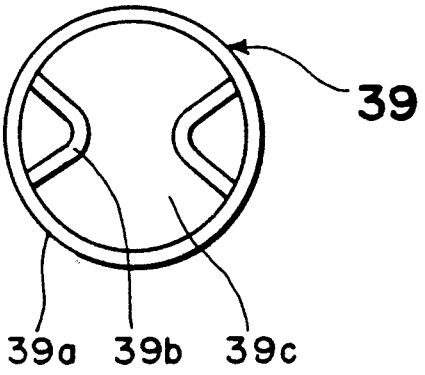
Fig. 13(b) PRIOR ART
Figure 14:
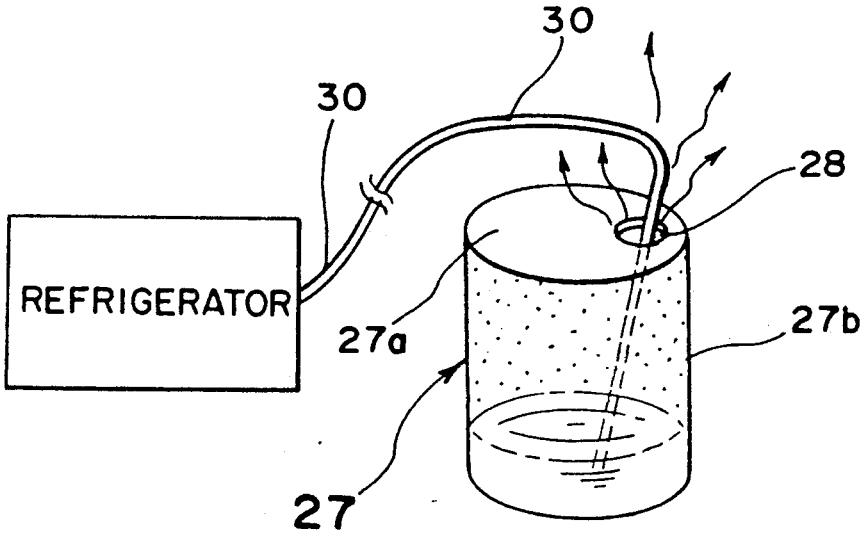
Fig. 14 PRIOR ART
FIG. 14 is a sketch for explaining a conventional method for sucking out liquid from a bomb.

The threaded plug retainer 4 is formed so that the lower end thereof has semi-circular convex part 4*b*, 4*b* shown in FIGS. 1,2(*a*),2(*b*) and 12 which detachably fit in the semi-circular concave parts 29*b*, 29*b* of the threaded plug 29 shown in FIG. 13(*a*) screwed onto the opening 28 of the bomb 27 so as to be able to transmit a rotation torque for tightening or loosening of the threaded plug 29. In other words, the threaded plug retainer 4 has a geometry detachably fitted in the threaded plug 29 so that the convex and concave parts 4*b*, 4*a* on the lower end of the retainer 4 respectively fit in the concave and convex parts 29*b*, 29*a* on the upper surface of the threaded plug 29. In order for the threaded plug retainer 4 to be applicable commonly to two kinds of commercial threaded plugs 29 and 39 shown in FIGS. 13(*a*) and 13(*b*), the retainer 4 has a geometry as shown in FIG. 12 on the confronting surface thereof. That is, the thread plug retainer 4 has the two convex parts 4*b* of approximately semi-circular shape separated from each other by a central groove 4*c*. The both end portions of the central groove 4*c* are expanded in V-character shape toward ends of the central groove 4*c* respectively. Therefore, the threaded plug retainer 4 can fit in both the threaded plug 29 having two semi-circular concave parts 29*b* shown in FIG. 13(*a*) and the threaded plug 39 having two V-character shape convex parts 39*b* shown in FIG. 13(*b*). It is to be noted in FIGS. 13(*a*) and 13(*b*) that reference numerals 29*a*, 39*a* and 39*b* designate convex parts and reference numerals 29*b* and 39*c* designate concave parts.

Referring to FIG. 1, the threaded plug retainer 4 has a magnet 26 buried on the confronting surface thereof in order to prevent the threaded plug 29 from dropping by the magnetic force when the retainer 4 fits loosely into the threaded plug 29.

The above described connector shown in FIGS. 1,2(*a*) and 2(*b*) is fastened to the bomb 27, covering the opening 28 thereof according to a fastening method comprising the following steps:

a step of removing the nut 14 from the threaded cylinder portion 11 of the base 9 and pushing the case fastening device 2 and the handle 3 together downward relative to the case 1;

a step of engaging each hook 13*b* with the outer circumferential recess 28*a* of the projected opening 28 of the bomb 27 and of fitting the threaded plug retainer 4 in the threaded plug 29 screwed onto the opening 28; and a step of pushing down the case 1 and of tightening the nut 14 onto the cylinder portion 11.

Thus, a hermetic chamber 17 enclosed by the case 1 and the top plate 27*a* of the bomb 27 is formed around the opening 28.

Next, the threaded plug 28 is loosened by turning the handle 3 and when it is unscrewed, the handle is lifted. Then, the opening 28 is opened within the hermetic chamber 17, as shown in FIG. 2(*b*).

By making the machine, for example, a centrifugal refrigerator 61 at the end of the hose 30 connected to the suction port 7 negative in pressure, a pressure difference is created between the bomb 27 under the atmospheric pressure and the refrigerator 61, and the liquid in the bomb 27, for example, R-11 is sucked into the refrigerator 61 through the hermetic chamber 17. At this time, it is possible to suck liquid u to the last drop without causing the gas leakage into the ambient.

Figure 3:
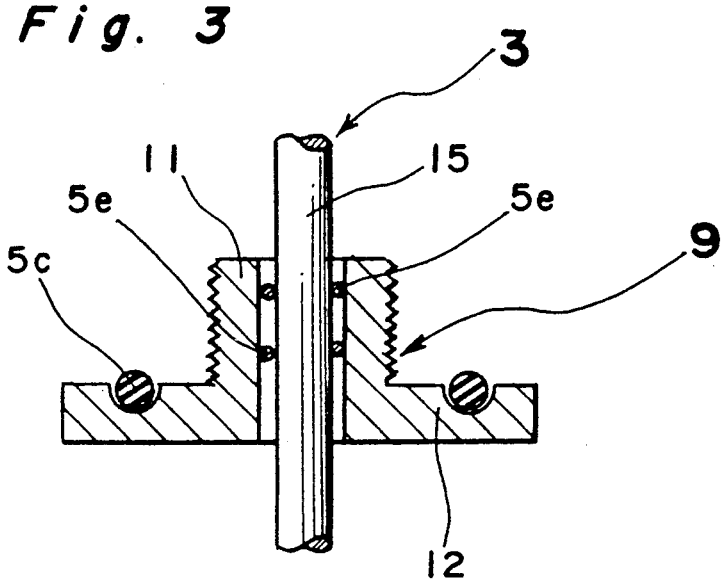
FIGS. 3 and 4 are sectional views of essential parts of modifications of the first preferred embodiment according to the present invention.

FIG. 3 shows an essential portion of a modification example, wherein V packings 5*b* in FIG. 1 are replaced by a pair of O-rings 5*e* without impairing the effect thereof.

Figure 4:
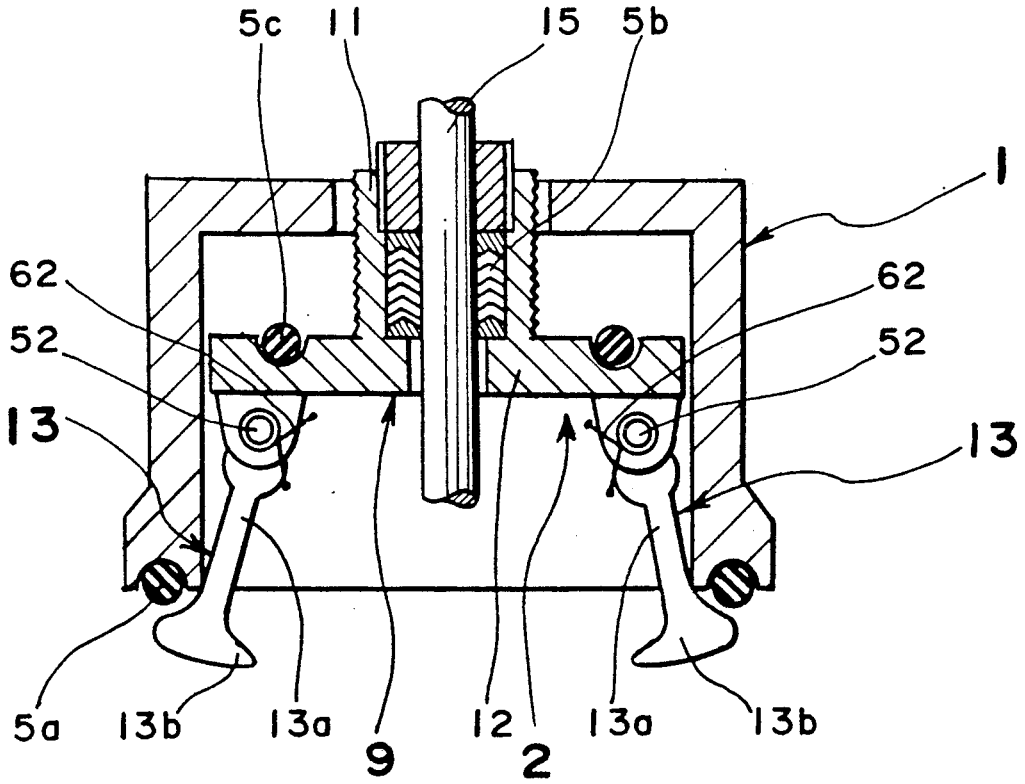

Moreover, as shown in FIG. 4, by providing a spring 62 around the pin 52 pivotally supporting the anchor member 13 so as to urge the anchor member 13 to expand outward, it is possible to interlock the expanding and contracting motion of the anchor member 13 with the push-up and push-down operation of the case fastening device 2 relative to the case 1. Thus, the hooks 13*b* of the anchor members 13 can be easily engaged with the outer circumferential recess 28*a* of the projected opening 28 of the bomb 27.

Figure 5:
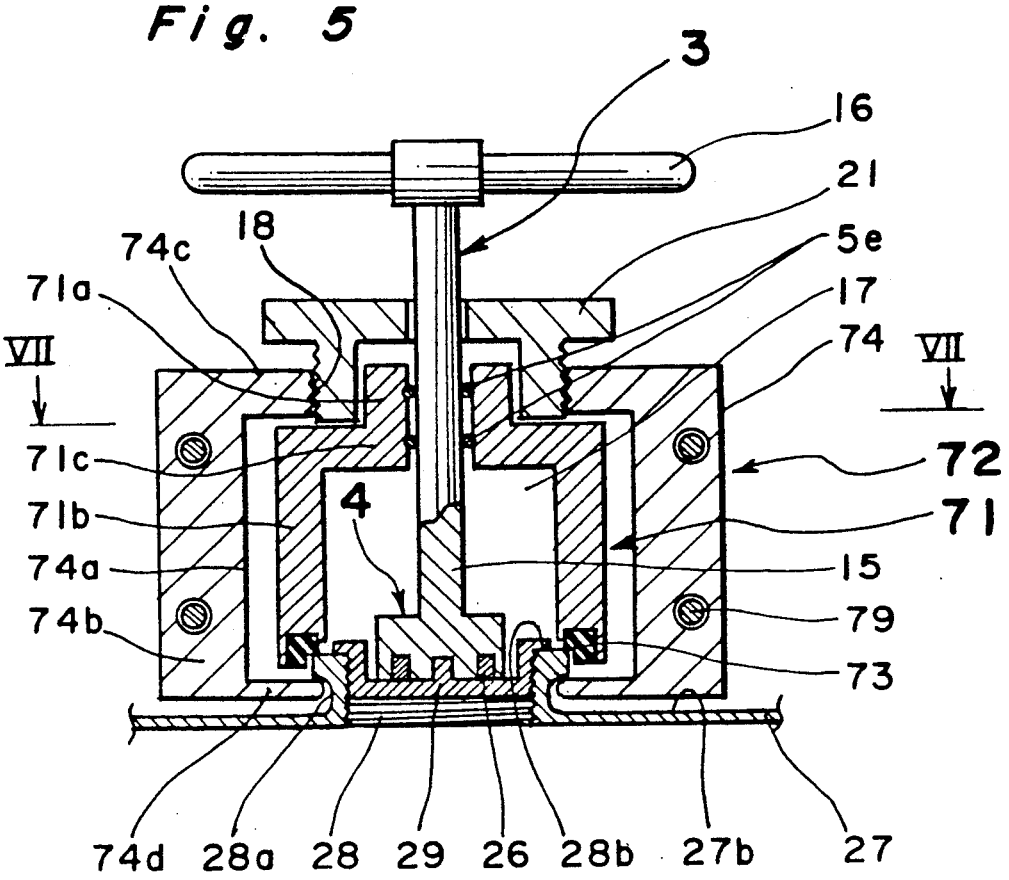
FIG. 5 is a longitudinal sectional view of a connector for a bomb of a second preferred embodiment according to the present invention.
Figure 6:
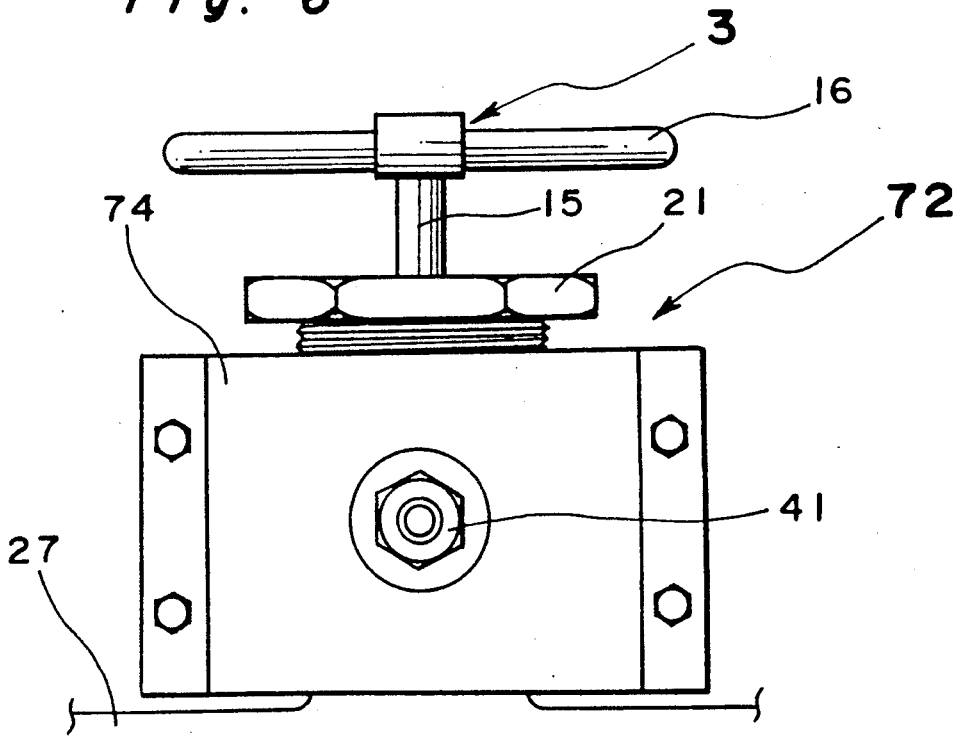
FIG. 6 is a front view of the second preferred embodiment according to the present invention.
Figure 7:
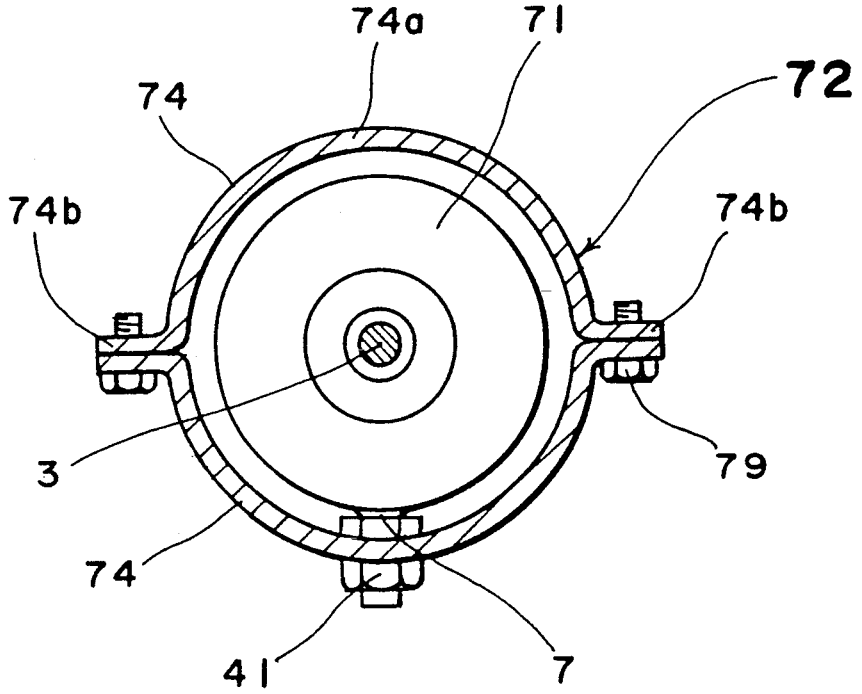
FIG. 7 is a cross sectional view of the second preferred embodiment cut along a line VII—VII in FIG. 5.

Next, a second preferred embodiment according to the present invention will be described with reference to FIGS. 5 through 7. In FIG. 5, the case 71 is a stepped cylinder coaxially having a smaller diameter portion 71*a* and a larger diameter portion 71*b*. The smaller diameter portion 71*a* is provided with a hole for passing a shaft portion 15 of the handle 3 therethrough, while the larger diameter portion 71*b* is formed to be so large as to be able to bring the lower end thereof into contact with the circumferential upper surface 28*b* of the projected opening 28 and has an inner diameter a little larger than the threaded plug 29, with a ring-shaped sealing member 73 of fluoric resin being provided on the lower end face thereof.

A case fastening device 72 is arranged outside the case 71 so as to enclose the case 71 and thus, the case 71 constitutes the inner casing relative to the case fastening device 72. The case fastening device 72 comprises a pair of saddle-shaped members 74 and a threaded sleeve 21 as shown in FIGS. 5 and 7. Each saddle-shaped member 74 is composed of a semi-circular cylinder portion 74*a*, connection flanges 74*b* continued to both side ends of the semi-circular cylinder portion 74*a* and projecting outward, a semi-circular wall 74*c* integrally provided on the upper edge of the semi-circular cylinder portion 74*a* so as to form a top wall thereof, and an inner flange 74*d* continued to the lower end portion of the semi-circular cylinder portion 74*a* and bent normal thereto. When the pair of saddle-shaped members 74, 74 are butted together and bolt-connected by using holes on the connection flanges 74*b* and bolts 79, a topped cylindrical member is formed with the inner flanges 74*d* being formed into a ring-shaped hook to be hooked onto the outer peripheral recess 28*a* of the opening 28 of the bomb 27 and with the semi-circular walls 74*c* being formed into a circular top wall. Further, on one saddle-shaped member 74, there is provided a hole for loosely passing a pipe joint 41 connected to a liquid suction port(not shown in FIG. 5) through the case 71.

As shown in FIG. 5, on the central portion of the top wall composed of the semicircular walls 74*c*, there is provided a threaded hole 18. A pushing member, that is, a threaded sleeve 21 has a hexagonal head, and is threaded on the outer surface so as to be screwed into the threaded hole 18 and this threaded sleeve 21 has an inner diameter a little larger than the outer diameter of the smaller diameter portion 71 of the case 71. The threaded sleeve 21 is screwed into the threaded hole 18 and lies outside the smaller diameter portion 71*a*.

On the other hand, the handle 3 is of the same structure as is shown in FIG. 1 with the shaft portion 15 thereof being inserted loosely into the case 71 and the threaded sleeve 21.

Between the shaft portion 15 of the handle 15 and the smaller diameter portion 71*a* of the case 71, there is provided sealing members, for example, two O-rings 5*e*.

In the connector having the above-described structure, after the pair of saddle-shaped members 74, 74 are tightened together temporally by bolts 79 and the threaded sleeve 21 is screwed into the threaded hole 18 by a few turns, the case 71 is positioned so that the lower end portion thereof contacts the upper end surface 28*b* of the projected opening 28, and then, the inner flange, i.e., hook 74*d* at the lower end of the saddle-shaped members 74, 74 are hooked onto the outer circumferential recess 28*a* of the opening 28, and after firmly tightening the saddle-shaped members 74, 74, the threaded sleeve 21 is screwed deeply into the threaded hole 18.

By screwing the threaded sleeve 21 into the threaded hole 18, the lower end of the threaded sleeve 21 pushes down the top wall 71*c* of the case 71 and brings the sealing member 73 provided on the lower end of the side peripheral wall 71*b* of the case 71 in contact with the upper flat end surface 28*b* of the projected opening 28. Thus, a hermetic chamber 17 is formed inside the case 71. At this time, the saddle-shaped members 72, 72 are engaged with the outer circumferential recess 28*a* of the projected opening 28 and serve as anchor members for balancing the reaction.

Thus, the case 71 is positioned within the case fastening device 72 and fastened in position, secured by the upper flat end surface 28*b* of the projected opening 28 and the threaded sleeve 21 from both in the downward and upward directions.

Thereafter, by pushing down the handle 3, the threaded plug retainer 4 is engaged with the threaded plug 29, and by turning the handle 3, the threaded plug 29 is unscrewed from the opening 28 and by pulling up the handle 3, the threaded plug 29 is separated from the opening 28. In this case, the threaded plug 28 does not drop out of the retainer 4, because the threaded plug 28 is attracted by the magnet 26.

Thus, the interior of the bomb 27 is communicated with the refrigerator through the opening 28 opened to the hermetic chamber 17 formed within the case 71, and R-11 in the bomb 27 is sucked out through the hermetic chamber 17, and no gas leakage into the atmosphere will take place.

In the above-described preferred embodiment, because the inner flanges 74*d* of the saddle-shaped members 74 of the case fastening device 72 are engaged with the outer circumferential recess 28*a* of the projected opening 28 and the threaded sleeve 21 of the case fastening device 72 fastening device 72 against the upper end 28*b* of the projected opening 28 so as to form a hermetic chamber 17, even when the projected opening 18 is formed on the side peripheral wall 27*b* constituting the cylindrical surface of the bomb 27, it is possible to form a hermetic chamber 17 and suck out liquid.

Figure 8:
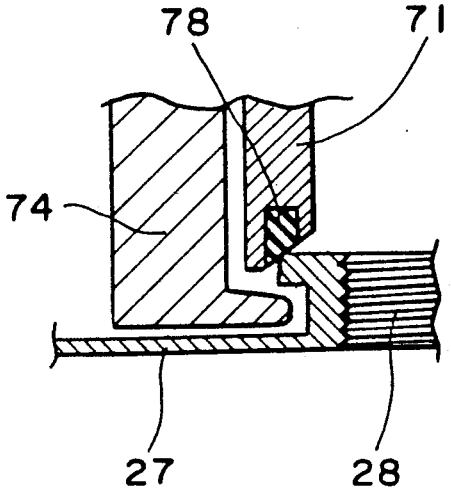
FIGS. 8 and 9 are sectional views of essential parts of the modifications of the second preferred embodiment.
Figure 9:
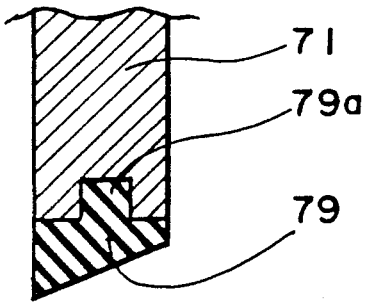

FIGS. 8 and 9 are sectional views showing the essential portions of modifications of sealing members provided on the lower end of the case 71. The sealing member 78 shown in FIG. 8 is ring-shaped with a trapezoidal section and the lower surface of the sealing member 78 is conical. The sealing member 79 shown in FIG. 9 is attached to the lower end of the case 71 with a projection 79*a* being provided thereon so as to fit in the lower end of the case 71.

Figure 10:
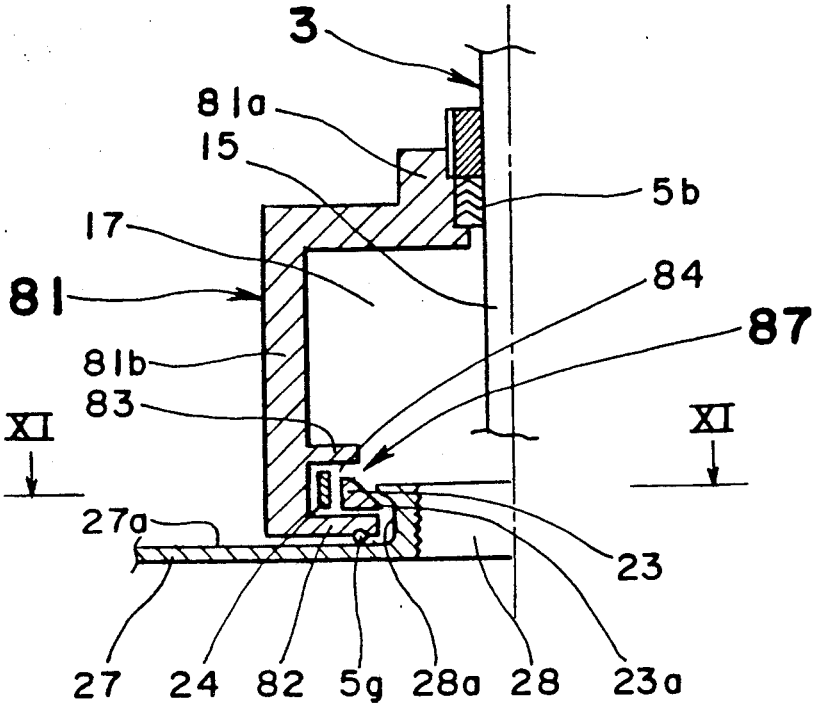
FIG. 10 is a longitudinal semi-sectional view of a third preferred embodiment according to the present invention.
Figure 11:
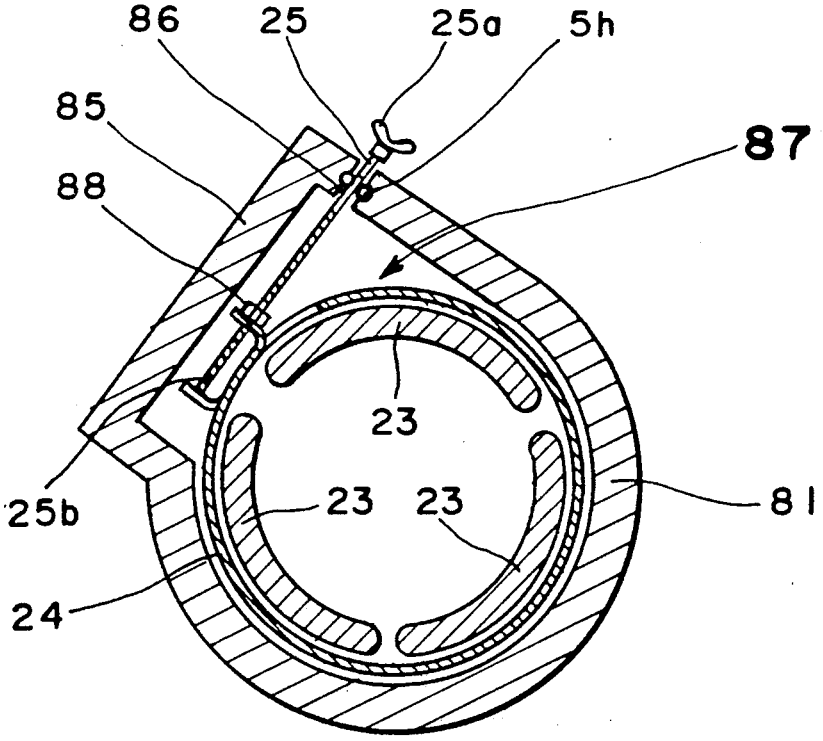
FIG. 11 is a cross sectional view of the third preferred embodiment cut along a line XI—XI in FIG. 10.

FIGS. 10 and 11 show a third preferred embodiment case 81 is approximately a stepped cylindrical body coaxially having a smaller diameter portion 81*a* and a larger diameter portion 81*b*, and on the smaller diameter portion 81*a*, there is provided a hole for passing a shaft portion 15 of a handle 3, and the larger diameter portion 81*b* is formed in a cylinder having a inner diameter a little larger than the outer diameter of the projected opening 28 of the bomb 27 with ring-shaped inner flanges 82 and 83 being provided on the lower end portion of the side peripheral wall of the larger diameter portion 81*b* of the case 81 so as to extend inward perpendicularly thereto. The lower inner flange 82 extends close to the outer circumferential recess 28*a* of the projected opening 28 of the bomb 27. The inner flanges 82 and 83 are provided with a predetermined spacing therebetween so as to form an annular groove 84.

On the outer peripheral side of the case 81 provided with the inner flanges 22, and 23, there is provided a substantially rectangular projecting portion 85, and in this projecting portion 85, there is provided a threaded operation shaft 25 with the grasp portion 25*a* of the threaded operation shaft 25 being exposed outside through a small hole 86 provided on the projecting portion 85. This operation shaft 25, the inner flange 82, a plurality of arc wedge members 23 and a belt 24 constitute a case fastening device 87.

The arc wedge members 23 are of arc shape as is obtained by dividing an annular ring into several parts, with a cross section of approximately right triangle. The arc wedge members 23 are arranged within the annular groove 84 on the inner flange 82 so as to be positioned by the inner flanges 82 and 83. A tapered portion 23*a* formed by the oblique surface and the horizontal surface of the arc wedge member 23 enters into the outer circumferential recess 28*a* of the projected opening 28 thus to become engaged therewith.

On the other hand, the band 24 contacts and encloses the arc shaped wedge members 23 arranged in a ring, with one end of the band 24 fixed to a nut 85 screwed on the threaded portion of the operation shaft 25 and the other end of the band 24 attached to the end 25*b* of the operation shaft 25 so as to enable the operation shaft 25 to rotate.

Therefore, the band 24 deforms so as to contract in diameter when the operation shaft 25 is turned clockwise, and to expand in diameter when the operation shaft 25 is turned anticlockwise. This operation of expanding or contracting the diameter can be effected from the outside of the case 81. Accordingly, by contracting the band 24, the arc shaped wedge members 23 can be hooked to the outer circumferential recess 28*a* of the projected opening 28 of the bomb 27.

On the lower surface of the inner flange 82, there is provided an O-ring 5*g* to maintain the air between the top plate 27*a* of the bomb 27 and the inner flange 82. Further, on the small hole 86 wherein the operation shaft 25 is loosely inserted, there is provided an O-ring 5*h* to seal the case 81 from the atmosphere.

Next, the handle 3 is of the same structure as each foregoing embodiment, and the shaft portion 15 pierces loosely the hole provided on the smaller diameter portion 81*a* of the case 81 with gland sealing members 5*b* being provided on the hole to maintain air tightness of this portion 81*a*.

In the connector of the above-described constitution, as shown in FIG. 11, when the operation shaft 25 is operated to tighten the band 24, the arc shaped wedge members 23 move to the right in FIG. 10 so as to enter and become engaged into the outer circumferential recess 28*a* of the opening 28 of the bomb 27. As a result, by the wedge members 23, the inner flange 82 is pushed against the top plate 27*a* around the opening 28 of the bomb 27 through the O-ring 5*g* and fastened.

Thus, the case 81 forms a hermetic chamber 17 in the inside thereof and fastened there, hermetically covering the opening 28, and R-11 in the bomb 27 is sucked into the refrigerator through a hermetic chamber 17.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A connector for a bomb comprising:

a case which has a top wall and a side peripheral wall with an opening for liquid discharging being formed on at least one of the top and side peripheral walls, and is capable of covering a projected opening of the bomb;

a case fastening device for fastening the case onto the bomb by utilizing an outer circumferential recess of the projected opening of the bomb;

a handle comprised of a shaft portion and a handle portion fastened to one end of the shaft portion with the shaft portion being arranged to rotatably and movably pass through the top wall of the case and the handle portion being positioned outside the case;

a threaded plug retainer which is fixed to the other end of the shaft portion of the handle and is detach ably engaged with a threaded plug screwed onto the projected opening of the bomb;

a first sealing member for sealing between an end portion of the side peripheral wall of the case and the bomb; and a second sealing member for sealing around the shaft portion of the handle, whereby the case is fastened to the bomb by the case fastening device so as to cover the projected opening of the bomb and to form a hermetic chamber, and by operating the handle, the threaded plug retainer engaged with the threaded plug is turned so as to detach the threaded plug from the projected opening of the bomb, and liquid in the bomb is sucked out through the hermetic chamber and the opening on the case.

2. The connector for a bomb as claimed in claim 1, wherein the case fastening device comprises:

a base composed of a flat plate portion disposed within the case, passed through by the shaft portion of the handle and capable of being tightly fit to an inside of the top wall of the case, and a cylinder portion integrated to the flat plate portion, rotatably and movably passed through by the shaft portion of the handle, and threaded on an outer surface of the cylinder portion;

a plurality of anchor members, each composed of an arm portion swingably hung onto the flat plate portion of the base and a hook connected to an end of the arm portion and capable of engaging with the outer circumferential recess of the projected opening of the bomb; and a nut engaging with threads formed on the outer surface of the cylinder portion of the base so as to pull up the base connected to the outer circumferential recess of the projected opening of the bomb by means of the anchor members and tightly push the flat plate portion of the base against the inside of the top wall of the case and at the same time, to push down the top wall of the case and push the end portion of the side peripheral wall of the case against the top wall of the bomb with the first sealing member being interposed between the end portion of the side peripheral wall of the case and the top wall of the bomb; and there is further provided a third sealing member for sealing between the inside of the top wall of the case and the flat plate portion of the base.

3. The connector for a bomb as claimed in claim 2, further comprising springs forcing the hooks of the anchor members to be pushed against the side peripheral wall of the case, whereby by moving the case toward the bomb relative to the anchor members, the anchor members contacting an inner edge of the end portion of the side peripheral wall of the case can be swung inward so as to engage the hooks of the anchor members with the outer circumferential recess of the projected opening of the bomb.

4. The connector for a bomb as claimed in claim 2, wherein the second sealing members are V-shaped packings provided in the cylinder portion of the base.

5. The connector for a bomb as claimed in claim 2, wherein the second sealing members are O-rings arranged between the base and the shaft portion of the handle.

6. The connector for a bomb as claimed in claim 1, wherein the end portion of the side peripheral wall of the case can be contacted with an upper end surface of the projected opening of the bomb;

the case fastening device comprises:

a pair of saddle-shaped members enclosing the case and detachable from each other, each of the saddle-shaped members having a semi-circular cylinder portion, connection flanges integrally provided on both side ends of the semi-circular cylinder portion, a semi-circular wall integrally provided on an upper edge of the semi-circular cylinder portion and an inner flange projecting inward from a lower end of the semi-circular cylinder portion so as to become engaged with the outer circumferential recess of the projected opening of the bomb, and a pushing member for pushing down the top wall of the case, which has threads formed on an outer surface of the pushing member, engaging with a threaded hole formed on a center of a top wall composed of the semi-circular walls of the saddle-shaped members, with the shaft portion of the handle passing through a center portion of the pushing member; and the second sealing members seal between the case and the shaft portion of the handle, whereby a pair of the saddle-shaped members are connected with each other by means of the connection flanges so as to enclose the case in the saddle-shaped members and engage the inner flange with the outer circumferential recess of the projected opening of the bomb, and the pushing member is screwed in the threaded hole on the top wall composed of the semi-circular wall of the saddle-shaped members so as to pull up the saddle-shaped members and hook the inner flange to the outer circumferential recess of the projected opening of the bomb, and at the same time to push the end portion of the side peripheral wall of the case against the upper end of the projected opening of the bomb with the first sealing member being interposed between the end portion of the side peripheral wall of the case and the upper end of the projected opening of the bomb.

7. The connector for a bomb as claimed in claim 6, wherein the first sealing member is an annular ring of polygonal section and is fitted in a groove provided on the end portion of the side peripheral wall of the case.

8. The connector for a bomb as claimed in claim 7, wherein the first sealing member has a conical surface contacting an outer edge of the upper end of the projected opening of the bomb.

9. The connector for a bomb as claimed in claim 1, wherein the end portion of the side peripheral wall of the case is able to press the first sealing member against the top wall of the bomb, and the case has an inner flange extending inward from the end portion of the side peripheral wall of the case close to the outer circumferential recess of the projected opening of the bomb, and the case fastening device comprises:

a plurality of arc-shaped wedge members of approximately triangular section which are arranged to be slid along the inner flange and become hooked to the outer circumferential recess of the projected opening of the bomb, a ring-shaped band enclosing outer peripheries of the wedge members, and a operation shaft which is connected to both ends of the band, piercing the case and is capable of operating from the outside of the case so as to tighten or loosen the band, whereby the band is tightened by the operation shaft so as to hook the wedge members into the outer circumferential recess of the projected opening of the bomb and the inner flange of the case is pushed against the top wall of the bomb through the arc-shaped wedge members so as to fasten the case onto the bomb; and a fourth sealing member is provided between the operation shaft and the side peripheral wall of the case.

10. The connector for a bomb as claimed in claim 9, wherein another inner flange is provided on the end portion of the side peripheral wall of the case so as to confront the inner flange, and in an annular groove formed between the both inner flanges, the arc-shaped wedge members are provided so as to be movable radially.

11. The connector for a bomb as claimed in claim 9, wherein the second sealing members are V-shaped packings provided between the shaft portion of the handle and the top wall of the case.

12. The connector for a bomb as claimed in claim 1, wherein there is provided a magnet o the threaded plug retainer so as to confront and attract the threaded plug.

13. The connector for bomb as claimed in claim 2, wherein there is provided a magnet on the threaded plug retainer so a to confront and attract the threaded plug.

14. The connector for a bomb as claimed in claim 6, wherein there is provided a magnet on the threaded plug retainer so as to confront and attract the threaded plug.

15. The connector for a bomb as claimed in claim 9, wherein there is provided a magnet on the treaded plug retainer so as to confront and attract the threaded plug.

16. The connector for a bomb as claimed in claim 1, wherein on an end face of the threaded plug retainer, there are provided two convex parts of approximately semi-circular shape separated from each other by a central groove, and both end portions of the central groove are expanded in V-character shape toward ends of the central groove respectively, whereby the threaded plug retainer is able to fit in both a threaded plug having two semi-circular concave parts and a threaded plug having two V-character shape convex parts.

17. The connector for a bomb as claimed in claim 2, wherein on an end face of the threaded plug retainer, there are provided two convex parts of approximately semi-circular shape separated from each other by a central groove, both end portions of the central groove are expanded in V-character shape toward ends of the central groove respectively, whereby the threaded plug retainer is able to fit in both a threaded plug having two semi-circular concave parts and a threaded plug having two V-character shape convex parts.

18. The connector for a bomb as claimed in claim 6, wherein on an end face of the threaded plug retainer, there are provided two convex parts of approximately semi-circular shape separated from each other by a central groove, and both end portions of the central groove are expanded in V-character shape toward ends of the central groove respectively, whereby the threaded plug retainer is able to fit in both a threaded plug having two semi-circular concave parts and a threaded plug having two V-character shape convex parts.

19. The connector for a bomb as claimed in claim 9, wherein on an end face of the threaded plug retainer, there are provided two convex parts of approximately semi-circular shape separated from each other by a central groove, and both end portions of the central groove are expanded in v-character shape toward ends of the central groove, whereby the threaded plug retainer is able to fit in both a threaded plug having two semi-circular concave parts and a threaded plug having two V-shape convex parts.

20. The connector for a bomb as claimed in claim 12, wherein on an end face of the threaded plug retainer, there are provided two convex parts of approximately semi-circular shape separated from each other by a central groove and both end portions of the central groove are expanded in v-character shape toward ends of the central groove respectively, whereby the threaded plug retainer is able to fit in both a threaded plug having two semi-circular concave parts and a threaded plug having two v-character shape convex parts.

21. A method for sucking out liquid in a bomb comprising the steps of:

arranging a cup-shaped case having a side peripheral wall and a top wall so as to cover a projected opening of a bomb;

fastening the case onto the bomb by pushing the case against the bomb by means of a case fastening device hooked onto an outer circumferential recess formed on the projected opening of the bomb so as to form a hermetic chamber within the case with a seal member;

engaging a threaded plug retainer fastened on an end of a shaft portion of a handle passing through the top wall of the case with a threaded plug on the bomb and removing the threaded plug from the bomb by turning the handle; and sucking out liquid in the bomb through the hermetic chamber and an outlet for piping provided on the case.

22. A method for charging liquid in a bomb comprising the steps of:

arranging a cup-shaped case having a side peripheral wall and a top wall so as to cover a projected opening of a bomb;

fastening the case onto the bomb by pushing the case against the bomb by means of a case fastening device hooked onto an outer circumferential recess formed on the projected opening of the bomb so as to form a hermetic chamber within the case with a seal member;

engaging a threaded plug retainer fastened on an end of a shaft portion of a handle passing through the top wall of the case with a threaded plug on the bomb and removing the threaded plug from the bomb by turning the handle; and charging liquid in the bomb through the hermetic chamber and an inlet for piping provided on the case.

* * * * *